United States Patent [19]

Nakayama

[11] Patent Number: 5,037,345

[45] Date of Patent: Aug. 6, 1991

[54] EATING TOY WITH VOCAL RESPONSE

[75] Inventor: Toshiaki Nakayama, Tokyo, Japan

[73] Assignee: Nakashou Giken Limited Company, Tokyo, Japan

[21] Appl. No.: 432,630

[22] Filed: Nov. 7, 1989

[51] Int. Cl.[5] ..... A63H 3/28; A63H 3/24

[52] U.S. Cl. ..... 446/297; 446/304

[58] Field of Search ..... 446/297, 298, 299, 300, 446/301, 302, 333, 304

[56] References Cited

U.S. PATENT DOCUMENTS 4,192,092 3/1980 Goldfarb et al. ..... 446/304

4,451,911 5/1984 Klose et al. ..... 446/303 X 4,565,536 1/1986 Vairo ..... 446/305

*Primary Examiner*—Mickey Yu

*Assistant Examiner*—D. Neal Muir

*Attorney, Agent, or Firm*—Gifford, Groh, Sprinkle, Patmore and Anderson

[57] ABSTRACT

A doll of a human baby, teddy bear or other shape is provided and has the capacity to ingest a simulated solid food item in its mouth and thereafter store it within its body, and produce one of a variety of responsive simulated voice expressions. The ingested food item may thereafter be recovered for reuse from a holding region of the doll.

12 Claims, 2 Drawing Sheets

EATING TOY WITH VOCAL RESPONSE

BACKGROUND OF THE INVENTION

I. Field of the Invention

The present invention relates to a doll, and more particularly to an eating and sound-producing doll.

II. Description of the Relevant Art

It is conventionally known that there is a doll having a baby figure to which one can give a liquid like milk through its mouth.

However, a doll of the above-mentioned type gives an impression to the user of interacting one-sidedly, and the doll's reaction is very small (only to wet a diaper), which caused a problem in that the doll's shape was limited to that of a baby.

A further problem is that one must replenish the liquid because of the difficulty of reusing the same liquid.

SUMMARY OF THE PRESENT INVENTION

The purpose of the present invention is to supply a doll that eliminates the above disadvantages.

To resolve the above-mentioned problems, a doll according to the present invention is constructed to utter a voice expression when a solid is inserted into its mouth and is received in its body.

Accordingly, when a real or an imitation biscuit or a toy fruit is inserted and received into its body (thus giving the appearance that the doll is eating the "food" itself), a voice expression is uttered as a signal of the conditions of eating or having eaten.

DETAILED DESCRIPTION OF THE PREFERRED EMBODIMENT

A preferred embodiment of the present invention will be explained with reference to the drawings.

Figure 1:
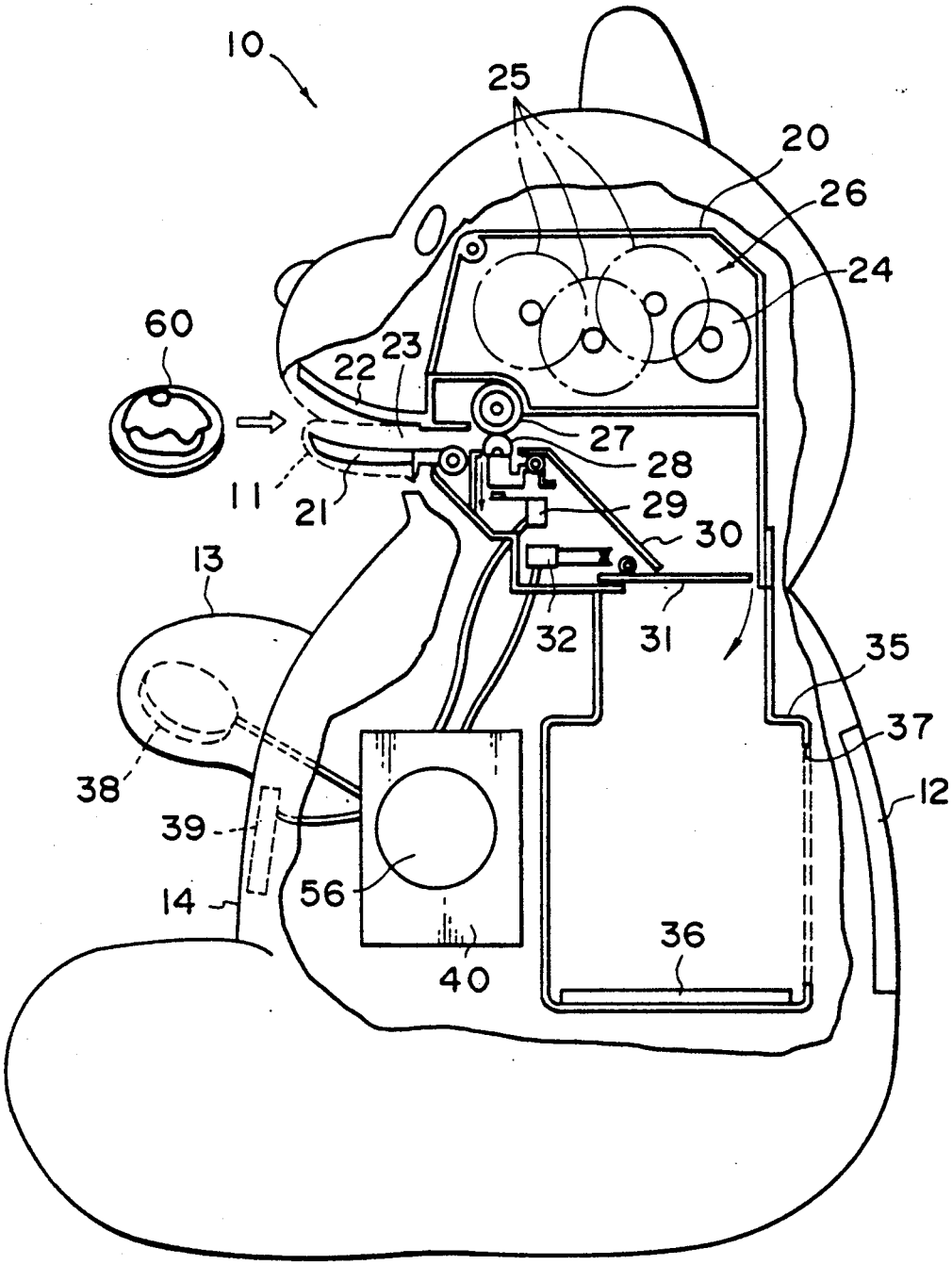
FIG. 1 is a side view showing the inside of a preferred embodiment of the present invention.

FIG. 1 is a side view showing an inside structure of the present invention applied to a stuffed doll 10 like a teddy bear.

In the drawing, 20 is a casing which takes in an inserted solid 60 (an imitation biscuit, etc.) from an opened lower jaw 11. A movable part 21 in the lower jaw 11 is attached near the inlet 23 between the lower jaw 11 and a guide piece 22.

At the upper part of the casing 20, an operation block 26 comprised of a motor 24 and some reduction gears 25 is provided.

This operation block 26 is connected to a leading roller 27 and to the movable part 21 provided adjacent to the inlet 23 at the non-illustrated side. Rotation of a motor 24 leads to counter-clockwise rotation of the leading roller 27, which results in the vertical movement of the movable part 21 with respect to the guide piece 22.

Beneath the leading roller 27, a press roller 28 is provided.

The press roller 28 is mounted under the lower surface of the leading roller 27 so that when the solid 60 is inserted between the rollers 27 and 28, a leaf spring switch 29 positioned under the roller 28 is lowered to close.

Behind the roller 27 and the press roller 28, a downwardly inclined slope plate 30 is provided to guide the solid 60 to a lower receiving case 35. At the lower end portion of the slope plate 30, a gate plate 31 is mounted to interrupt the solid passing through to the receiving case 35. The gate plate 31 is formed to swing in response to the weight of the solid 60 and to drop it into the receiving case 35. A second leaf spring switch 32 is provided at one end thereof and is closed by rotation of the gate plate 31.

At the receiving case 35 provided beneath the gate plate 31, an opening 37 is provided to allow the user to take out the solid 60 received on the bottom portion having a shock absorbing material 36 through a lid 12 provided at the back portion of the doll 10. The push-and-lock type push switches 38, 39 are built into the arm (front leg) portion 13 and an abdomen portion 14. Both switches 38, 39 are connected to a voice generating apparatus 40 together with the motor 24 in the casing 20 and two-leaf spring switches 29 and 32.

Figure 2:
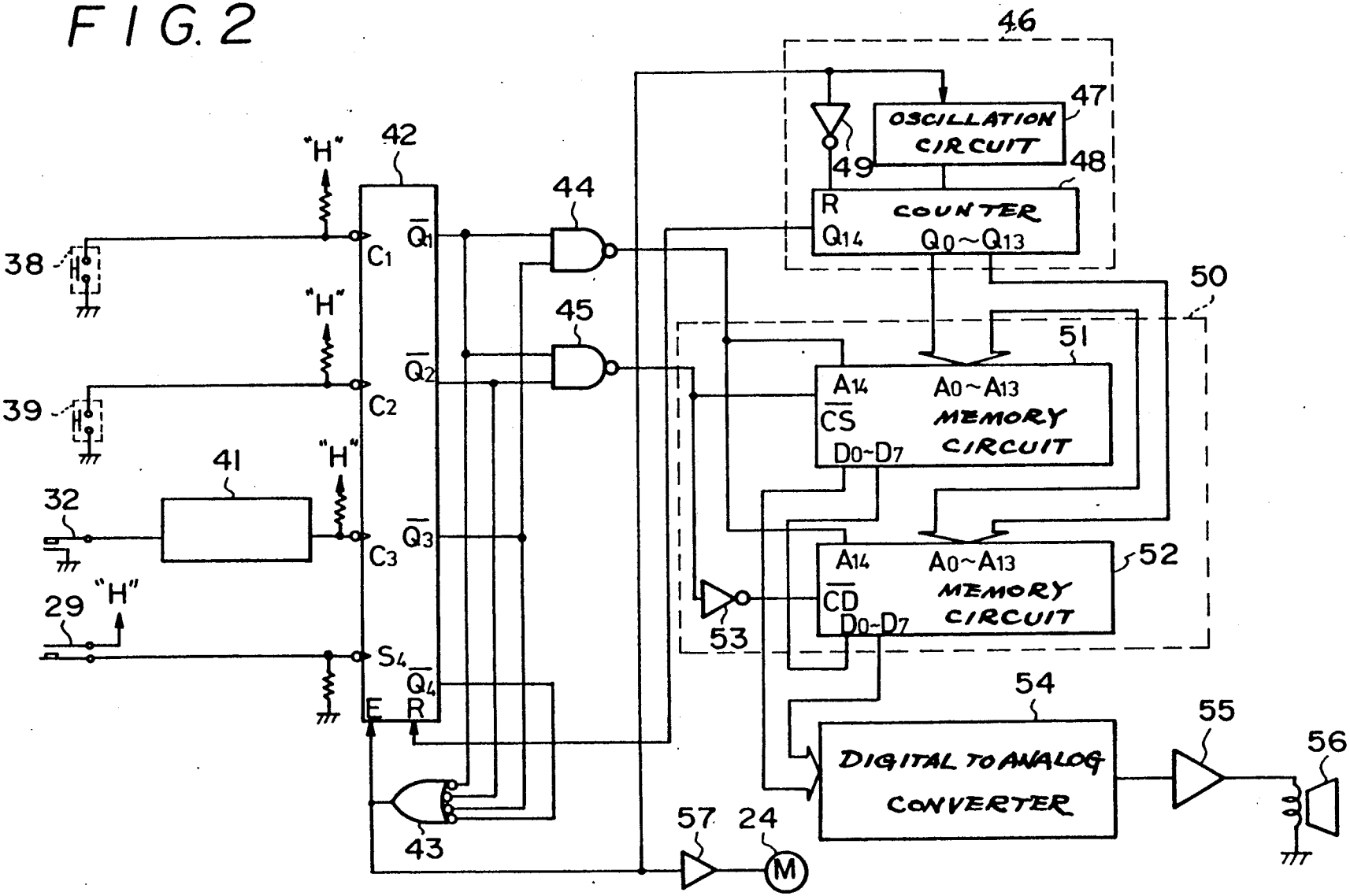
FIG. 2 is a block diagram showing the main parts of the preferred embodiment of the present invention.

FIG. 2 is a block diagram showing a construction of the voice generating apparatus 40. The diagram illustrates, in part, the first and second leaf spring switches 29 and 32 and push-and-lock switches 38 and 39 all connected to a select circuit 42.

At FIG. 2, element 41 is a timer circuit which outputs a signal of logical level (e.g., "L" level) at a predetermined time after identifying the closed condition of the leaf spring switch 32 which interlocks the gate plate 31.

The output of the timer-circuit 41 is input to each of three clock terminals C1–C3 of a select circuit 42 together with two push-and-lock switches 38, 39 leveled up to "H" level, while the leaf spring switch 29 is inputted to a set terminal S4 which is to set the inverted output Q4 of the select circuit 42 to an "L" level.

The select circuit 42 is composed of a flip-flop or the like to change the inversed output which reacts when any four switches are closed to an "L" level, and it is composed to receive the output of a NAND circuit 43 which is set to four inverted outputs Q1–Q4 being inputs at receipt-inhibit terminal E, and when any one of the inverted outputs is in "L" level, not to receive the input signal change before it receives the reset signal.

However, when the leaf spring switch is closed, if it receives the reset signal, immediately the inverted output Q4 is set to "L" level.

When output is inverted, the NAND circuit 44 outputs to Q1, Q3 and the NAND circuit 45 outputs to Q1, Q2 to cause an address change-over signal and a tip select signal to change the memory range of storage circuit 50.

The output of the NAND circuit 43 is input both the receipt-inhibit terminal E of the select circuit 42 and to a read out circuit 46.

The read out circuit 46 consists of an oscillation circuit 47 which outputs the predetermined frequency pulse signal when the output of the NAND circuit 43 reaches an "H" level. A binary counter 48 counts the pulse signal and outputs the undercounting discrete value as an address signal. An invertor 49 inverts the output from the NAND circuit 43 and outputs to the reset terminal of the counter 48.

In addition, the counter 48 has a 15 bit output. The uppermost 15th bit output is connected to the reset terminal of the select circuit 42 and the other 1st–14th outputs are set to output to the storage circuit 50 as the address signal.

The storage circuit 50 consists of two memory circuits 51, 52 having at least a 15 bit address input, each memory circuit 51, 52 having previously memorized a series of voice data which differs in every half of each memory range.

That is to say, a series of voice data corresponding, when transformed into voice expression to "It's good" or some crunching noise is memorized in the lower range of the memory circuit 51, and in turn from lower address, "I'm full" is in the upper range thereof. "I'm hungry" is in the lower range of the memory circuit 52 and "Let's take a walk" is in the upper range thereof.

In addition, 53 is an invertor for inverting the tip select signal to output to the memory circuit 52.

A digital-to-analog converter 54 converts the 8 bit voice data which is the output from memory circuit 51, 52 into an analog signal, and element 55 is an amplifier which generates the voice signal through a speaker 56.

A motor driver 57 drives the motor 24 during the output of the NAND circuit 43 to maintain "H" level.

Operation of Before-mentioned Embodiment

The explanation of the before-mentioned embodiment is as follows.

To insert a toy biscuit 60 of a solid form into the mouth of the doll 10, the lower jaw 11 is opened downwardly, and the toy biscuit 60 is inserted toward the back between the leading roller 27 and the press roller 28.

Owing to this insertion, the press roller 28 descends downwardly to close the leaf spring switch 29. This leads to setting the inverted ouptut Q4 of the select circuit 42 to "L" level.

Accordingly, the output of the NAND circuit 43 is powered to "H" level to drive the motor 24, and the toy biscuit 60 is subsequently drawn inside by the rotation of the leading roller 27, while the lower jaw 11 moves vertically.

At this time, the other inverted output being "H" level of the initial state, and the output of NAND circuits 44, 45 being both at "L" levels, the voice data memorized in the lower range of the memory circuit 50 of the storage circuit 51 is outputted by counting the output value of the counter 48 that counts the pulse of the oscillation circuit 47 to the digital-to-analog converter 54 in turn as the address signal.

Accordingly, we can hear the voice of "It's good" or we can hear a crunching noise through the speaker 56.

After the series of voices and the concurrent advancement of the count of the counter 48 until it reaches the highest bit to "H" level, the select circuit 42 is reset, the inverted output Q4 returns to "H" level, and the output of the NAND circuit 43 reaches the "L" level.

Accordingly, the oscillation of the oscillator 37 stops and the counter 48 is reset to return to the initial state.

However, in case the biscuit 60 is still between the leading roller 27 and the press roller 28 after the above reset, the inverted output Q4 is set to "L" level in an instant so that the taking-in of the biscuit 60 is continued with the vertical action of the lower jaw 11. The same voice is repeated throughout this procedure.

When the biscuit 60 passes through between the rollers, the leaf spring switch 29 opens so that a series of voices is heard and then finishes at that time and the select circuit 42 is reset to return to the initial state, and the motor 24 stops.

When the biscuit 60 has passed through between the rollers, and slides down the slope plate 30 to reach the gate plate 31, the plate 31 rotates, which leads the leaf spring switch to close. The biscuit 60 thereafter falls and is received in the receiving case 35.

The output of the timer circuit 41 reaches "L" level after a predetermined interval following the closure of the leaf spring switch 32 (that is to say, after the finish of a series of voices continuously sounded from the time of the beginning of the taking-in of the biscuit 60), and the inverted output Q3 reaches "L" level, then the voice data memorized in an upper range of the memory circuit 51 is transformed in turn into an analog signal, the lower jaw 11 moves vertically with a statement "I'm full!" for example.

Besides, by holding the arm 13 of the doll 10, the push switch 38 is closed so that it outputs in turn the voice data memorized in the upper range of the memory circuit 52 through moving its mouth to articulate the phrase, "Let's go for a walk", for example. In the same way, if you push its abdomen, the doll 10 speaks by moving its mouth to articulate the phrase, "I'm hungry" by means of the voice data memorized in the lower range of the memory circuit 52.

In the above-mentioned embodiment, although it is described that the doll sounds a voice also when the arm 13 and the abdomen 14 are pushed, this feature may be omitted. Instead, when another switch detects that the receiving case is full of solids 60, the phrases "I'm full" or "I can't eat any more" may be uttered.

And, in the above-mentioned embodiment, although the taking-in of the solid and vertical movement of the lower jaw is carried out by using a rotation of the motor 24, this action may be undertaken by another mechanism.

Furthermore, in the above-mentioned embodiment, a voice is continuously uttered during the closed state of the leaf spring switch 29. After the time required, the voice activated by the leaf spring switch 32 is uttered following a delay, but in case it takes only a short time to withdraw the solid, the timer circuit is excluded and the leaf spring switch is inputted to clock input C4 (not shown). According to this construction, the voice is uttered only once when the solid is withdrawn.

In the above-mentioned embodiment, although the voice data memorized in the memory circuit 51, 52 is read out in turn by alternating an address, a conventional small-sized tape recorder may be used.

In addition, although the above-mentioned embodiment is fitted into a teddy bear doll, it is of course fittable within other dolls (some being of human shape).

As described above, the doll of this invention is constructed to utter a voice when the solid is withdrawn within a body, which appears as if the food is being eaten and owing to the many vocalized responses, it appears to have a natural expression.

Further, because it is possible to employ the present invention not only in a conventional baby doll but also in another type of doll, this invention has a wide application.

Futhermore, the received solid can be reused, and therefore needs no further supplement.

I claim:

1. An eating and sounding doll, comprising: a body;

a movable part defined on said body, said part permitting the introduction of an object;

an operational block within said doll body, said block causing opening and closing of said movable part, said block further causing said object to be conveyed within said doll body;

electronic means for storing multiple vocal messages;

power means operatively linked to said operational block, electronic means and to an output means;

a receiving case for receiving and holding said object within said doll; and output means for selecting and generating a particular vocal message in response to placement of a given said object within said doll.

2. The invention as described in claim 1, wherein said means for generating a vocal message comprises, a voice generating apparatus, said apparatus contained within said doll body.

3. The invention as described in claim 2, comprising in addition first and second leaf spring switches, said switches connected to said voice generating apparatus.

4. The invention as described in claim 2, comprising in addition push-and-lock switches located in proximity to the surface of said doll body, said switches connected to said voice generating apparatus.

5. The invention as described in claim 1, comprising in addition a leading roller and a press roller, said rollers causing deflection of said movable part so as to receive said object, said object further being communicated by a slope plate and a gate plate to said receiving case.

6. The invention as described in claim 5, wherein said press roller deflects upon contact with said object causing said second leaf spring switch to close and in turn generate circuit output resulting in said voice message.

7. The invention as described in claim 4, wherein said voice generating apparatus comprises said first and second leaf spring switches and said push-and-lock switches all connected in parallel to a select circuit, said circuit responding to the closing of any of said four switches by outputting an appropriate signal.

8. The invention as described in claim 7, comprising in addition three NAND circuits, said circuits enabling said select circuit to output one of two memory circuits contained within said doll.

9. The invention as described in claim 8, comprising in addition a readout circuit, said readout circuit having an oscillation circuit and a binary counter, said oscillation circuit displaying a predetermined frequency pulse signal when said first of three NAND circuits issue an output.

10. The invention as described in claim 9, wherein said binary counter counts said pulse signals from said oscillation circuit, said counter in turn outputting a discrete signal.

11. The invention as described in claim 10 wherein said discrete signal from said binary counter is addressed to one of said memory circuits as a result of the number of signals counted, said memory circuit in turn outputting a particular voice message signal.

12. The invention as described in claim 10, wherein a digital-to-analog converter receives said output signal from either of said memory circuits, said converted signal being communicated to an amplifier, said amplifer amplifying said signal and delivering said signal to a loudspeaker.

* * * * *